US005577930A

United States Patent [19]

Dahlem et al.

[11] Patent Number: 5,577,930

[45] Date of Patent: Nov. 26, 1996

[54] ELECTRICAL CONNECTOR WITH IMPROVED CONDUCTOR RETENTION MEANS

[75] Inventors: Charles Dahlem, Carol Stream; Paul Murphy, Naperville; Joseph W. Nellington, Jr., LaGrange Park; Paul A. Reisdorf, LaGrange; Stephen A. Sampson, Downers Grove, all of Ill.

[73] Assignee: Molex Incorporated, Lisle, Ill.

[21] Appl. No.: 496,261

[22] Filed: Jun. 28, 1995

[51] Int. Cl.[6] ..... H01R 4/24

[52] U.S. Cl. ..... 439/399; 29/866; 439/400; 439/452; 439/460

[58] Field of Search ..... 439/399, 400, 439/401, 452, 460; 29/861, 865, 866

[56] References Cited

U.S. PATENT DOCUMENTS

| | | | |
|---|---|---|---|
| 4,191,442 | 3/1980 | Caveney et al. | 439/400 |
| 4,227,763 | 10/1980 | Marks | 439/404 |
| 4,653,831 | 3/1987 | Wilson et al. | 439/404 |
| 4,836,803 | 6/1989 | Seidel et al. | 439/447 |
| 5,030,136 | 7/1991 | Reinhardt et al. | 439/460 |
| 5,073,126 | 12/1991 | Kikuchi et al. | 439/452 |

FOREIGN PATENT DOCUMENTS

| | | | |
|---|---|---|---|
| 104013 | 3/1984 | European Pat. Off. | 439/400 |
| 251736 | 1/1988 | European Pat. Off. | 439/400 |
| 4331036 | 3/1994 | Germany | 439/404 |
| 2197548 | 10/1987 | United Kingdom | H01R 11/20 |

*Primary Examiner*—Gary E. Elkins
*Attorney, Agent, or Firm*—A. A. Tirva

[57] ABSTRACT

An electrical connector includes a dielectric housing having a conductor-receiving groove defined at least in part by a pair of side walls between which an elongated insulated conductor is receivable essentially normally of its length. An electrical contact has an insulation displacement termination section disposed in the groove. A pair of inwardly-directed wings are provided in the groove and spaced from and facing one another to provide a slot therebetween. The conductor is movable through the slot past free ends of the wings into insulation-displacement termination with the termination section of the contact. A pair of retention ribs face inwardly of the side walls of the groove essentially below the wings for embracing and thereby retaining the conductor terminated by the contact.

14 Claims, 5 Drawing Sheets

ELECTRICAL CONNECTOR WITH IMPROVED CONDUCTOR RETENTION MEANS

FIELD OF THE INVENTION

This invention generally relates to the art of electrical connectors and, particularly, to an electrical connector having an improved means for holding or retaining an elongated conductor in terminated position within the connector.

BACKGROUND OF THE INVENTION

Generally, electrical connectors include a dielectric housing mounting a plurality of conductive terminals for making electrical connection between a pair of electrical devices. For instance, one electrical connector may mate with another complementary electrical connector with the respective terminals thereof interengaging. Other electrical connectors may interconnect a conductor of an electrical wire to a circuit trace on a printed circuit board. Electrical connectors have been provided in a myriad of designs and constructions.

One type of electrical connector is commonly called an insulation displacement (IDT) connector which is equipped with insulation displacement terminals (IDT) for termination of insulated conductors. Such connectors have been called "solderless" connectors. In essence, elongated insulated conductors or wires are terminated within connector housings by forcing portions of the terminals through the outer insulation of the wires and into engagement with the central conductive cores of the wires. Such connectors normally require some form of means for holding the conductors or wires within the connector housing after termination with the terminals.

One type of conductor holding or retaining system provides a pair of flexible arms or wings which extend downwardly into a conductor-receiving groove to allow the conductor to be terminated as the conductor is moved past free ends of the wings into insulation displacement termination with the terminals. The wings prevent the conductor from backing out of its terminated position.

One problem with conductor holding or retaining systems as described above is that any given connector, including its flexible arms or wings, can be used with only one particular size or gauge of conductor. In other words, if the conductor is too small for the particular connector arrangement, there may not be sufficient force on the conductor to provide retention or strain relief to prevent movement of the conductor out of its terminated position or from damaging or adversely affecting the integrity of the mechanical and electrical connection between the terminal and the conductor. One solution to these problems has been to provide different sizes of connectors and/or different sizes of flexible retaining arms or wings for different sizes of conductors to be terminated in the connector. This solution significantly increases the cost of manufacturing such connectors by requiring an unduly large inventory of connector housings to accommodate a variety of conductor sizes.

The present invention is directed to solving these problems by providing an electrical connector with an improved conductor retention system that can accommodate a range of conductor sizes.

SUMMARY OF THE INVENTION

An object, therefore, of the invention is to provide an electrical connector of the character described with a new and improved conductor retention means or system.

In the exemplary embodiment of the invention, the electrical connector includes a dielectric housing having a conductor-receiving groove or trough defined at least in part by a pair of side walls between which an elongated insulated conductor is receivable essentially normally of its length. At least one electrical contact is disposed in the groove. The contact has an insulation displacement termination section. A pair of inwardly-directed wings are provided in the groove and spaced from and facing one another to provide a slot therebetween. The conductor is movable through the slot past free ends of the wings into insulation-displacement termination with the termination section of the contact. A pair of retention ribs face inwardly of the side walls of the groove essentially below the wings for embracing and thereby retaining the conductor terminated by the contact. The ribs allow for retaining a range of conductor sizes because the ribs can indent into the insulation of the conductors of varying diameters.

As disclosed herein, the retention ribs include inwardly facing generally flat edges for engaging the conductor to prevent the ribs from cutting into the conductor. The inwardly facing edges are located below the free ends of the wings.

The connector herein is designed to include one pair of the retention ribs on each opposite longitudinal side of the contact. Two pairs of the wings are spaced longitudinally of the groove with the contact and the pairs of retention ribs disposed therebetween.

The invention also contemplates a system wherein the retention ribs include deformed portions overlying the terminated conductor. The deformed portions can be formed during assembly of the connector by a tool which inserts the conductor into the insulation displacement contact or terminal. In fact, the invention contemplates employing a tool having sharp edges to skive or "shave" portions of the plastic material of the retention ribs and deform that material over the top of the conductor.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
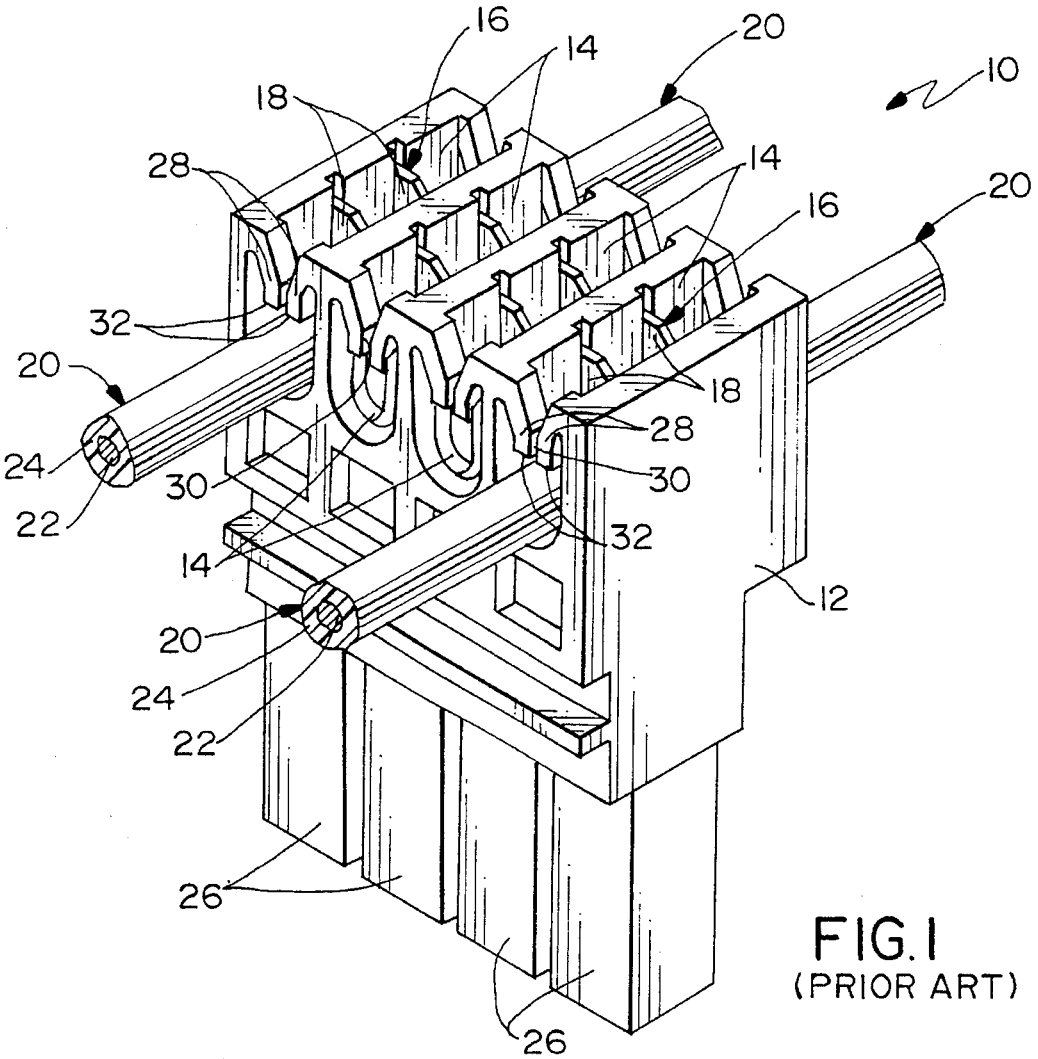
FIG.1 (PRIOR ART)
FIG. 1 is a perspective view of an electrical connector of the prior art.

Referring to the drawings in greater detail, and first to FIG. 1, an electrical connector, generally designated 10, is shown in accordance with the prior art. The connector includes a dielectric housing 12 having a plurality (four) of conductor-receiving grooves or troughs 14. The housing can be unitarily molded of plastic material. An electrical contact or terminal 16 is disposed in each groove. Each terminal has an insulation displacement termination section defined by a pair of blades 18 which cut through or pierce the insulation of an insulated conductor to establish a mechanical and electrical connection with the central conductor core of the conductor. These types of insulation displacement contacts or terminals are known in the art.

Figure 2:
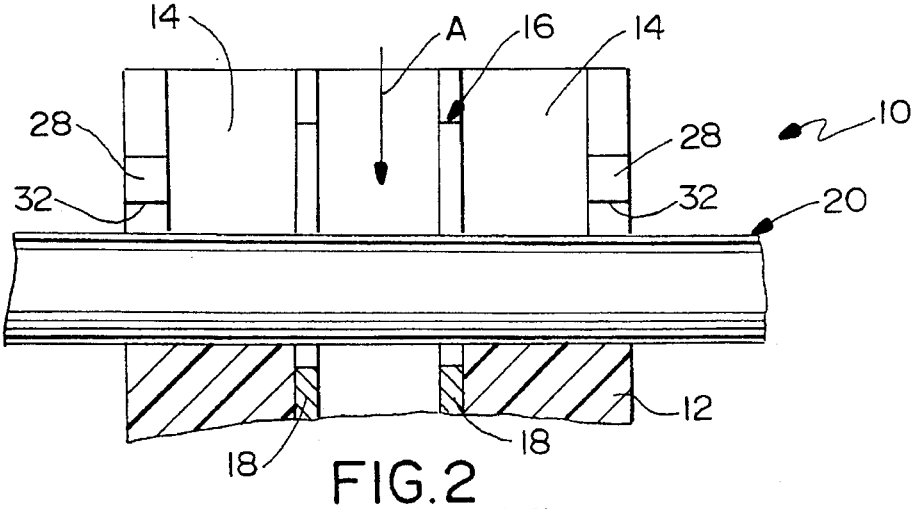
FIG.2 (PRIOR ART)
FIG. 2 is a fragmented axial or longitudinal, vertical section through one of the conductor-receiving grooves or troughs of the prior art connector.

Referring to FIG. 2 in conjunction with FIG. 1, each conductor is terminated into one of the conductor-receiving grooves 14 in the direction of arrow "A" (FIG. 2). Each conductor, generally designated 20, includes a central conductive core 22 (FIG. 1) surrounded by an insulative sheath or cladding 24. Blades 18 are effective to cut through or pierce insulation 24 and establish an electrical connection with conductive core 22 automatically as the conductor is forced into the connector in the direction of arrow "A". Each contact 16 has a mating portion (not shown) that projects into one of a plurality of "silos" 26 formed integrally with housing 12 and which mate with a complementary mating connector (not shown).

Electrical connectors of the type described above in relation to FIGS. 1 and 2 normally include some form of retention means or system for holding the conductors in their terminated condition with the insulation displacement contacts or terminals. In connector 10, the retention means is provided by a pair of inwardly-directed wings or legs 28 which project into each conductor-receiving groove 14. The wings are spaced from and face one another to provide a slot 30 therebetween. When a respective conductor 20 is terminated into the connector by insertion into a respective groove 14, the conductor is moved past free ends 32 of wings 28 and into insulation-displacement termination with contacts 16.

A problem with electrical connectors such as connector 10 shown in and described above in relation to FIGS. 1 and 2, is that each groove accommodates only one size of insulated conductor. Looking back at FIG. 1, the central two conductors have been removed to facilitate the illustration. It can be seen that the bottom of each groove 14 is generally semi-cylindrical. Preferably, the diameter of this semi-cylindrical section of the groove, as well as the width of the groove itself, is limited to the diameter of the conductor or else the conductor has too much "play" within the connector after termination. If the conductor is not properly held or retained, it can move and destroy the integrity of the mechanical/electrical connection with its respective insulation displacement contact 16. Heretofore, the solution to this problem has been to provide multiple connector housings to accommodate multiple sizes or gauges of electrical wires or conductors, but this solution is not cost effective because of the large inventory of connectors or connector housings that are required.

Figure 3:
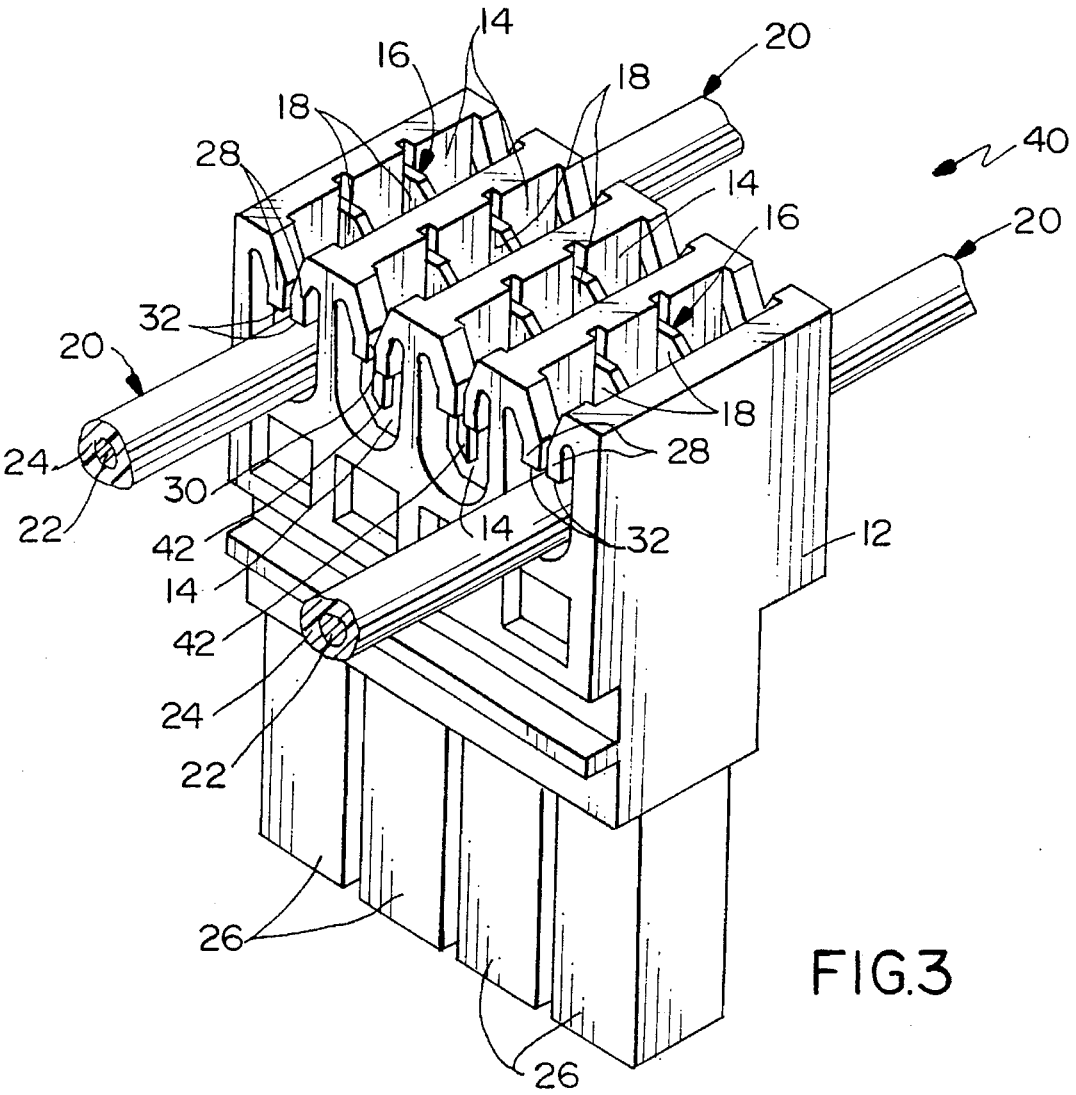
FIG. 3 is a perspective view of an electrical connector embodying the concepts of the invention.
Figure 4:
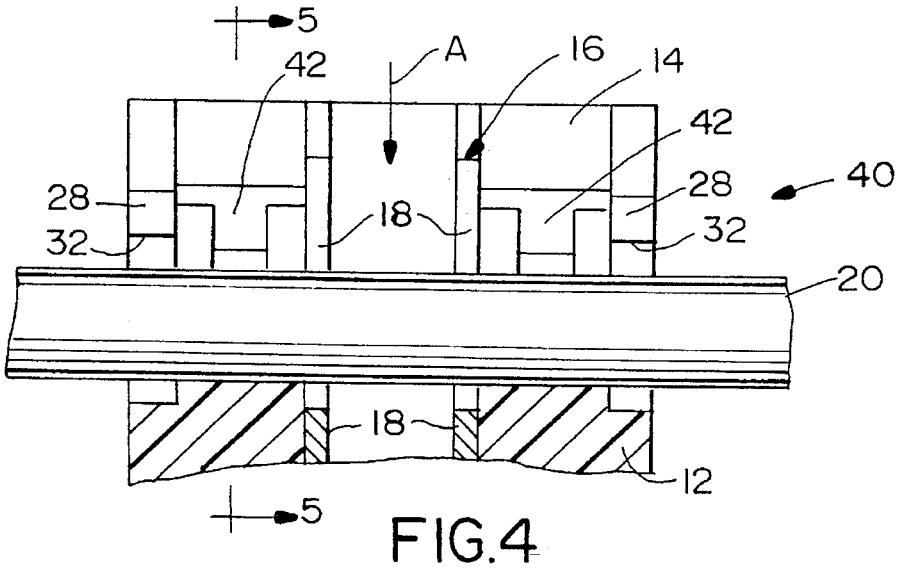
FIG. 4 is a fragmented axial or longitudinal, vertical section through one of the conductor-receiving grooves or troughs of the connector of FIG. 3.

FIGS. 3 and 4 show an electrical connector, generally designated 40, which intentionally is depicted as being substantially like connector 10 in FIGS. 1 and 2, except that connector 40 incorporates the retention means or system of the invention. Therefore, like numerals have been applied to like elements or components in FIGS. 3–9 corresponding to like components described above and shown in FIGS. 1 and 2. Basically, the invention is embodied in an additional retention means within each conductor-receiving groove 14 to accommodate conductors 20 of varying sizes.

Figure 5:
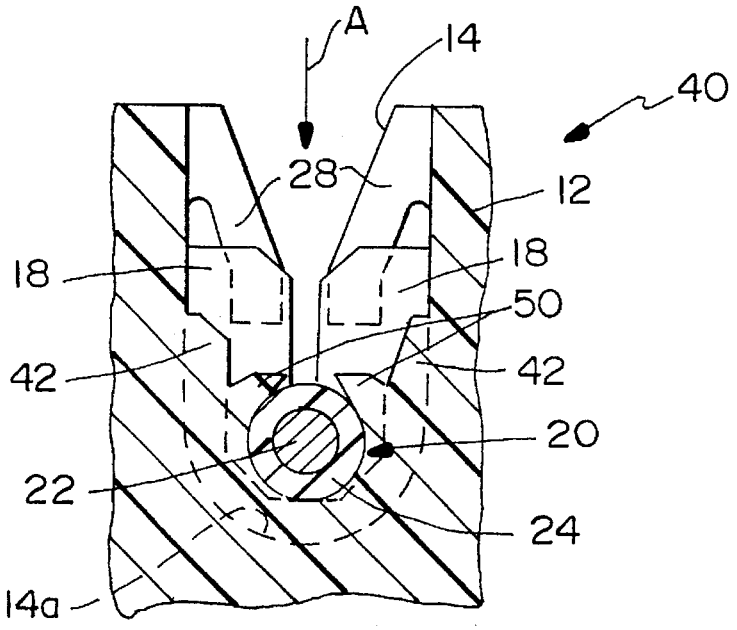
FIG. 5 is a fragmented vertical section taken generally along line 5—5 of FIG. 4.
Figure 6:
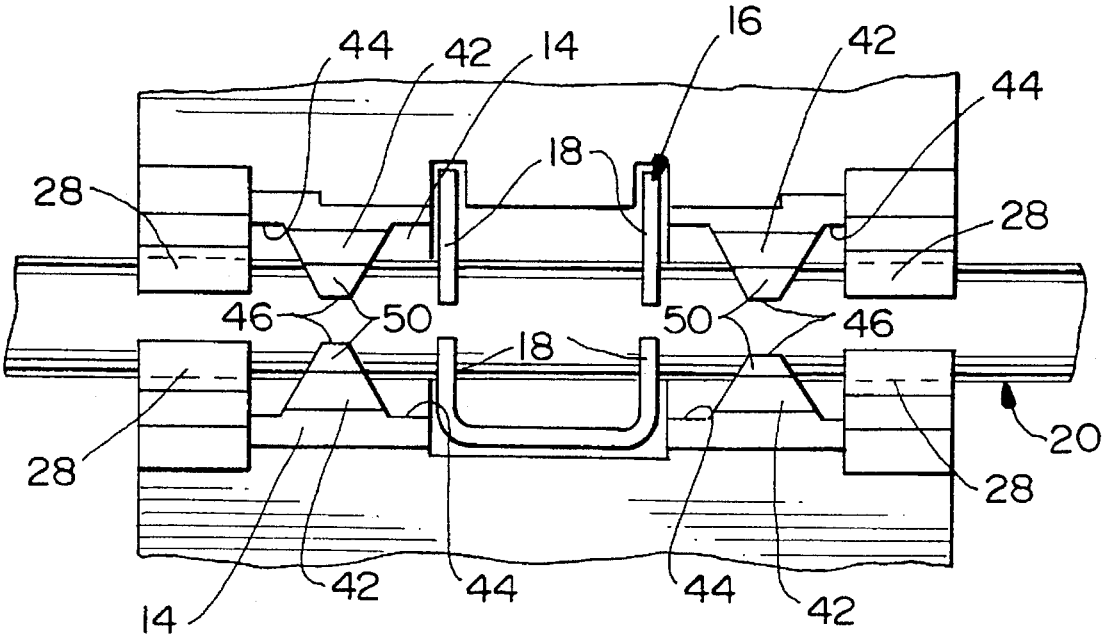
FIG. 6 is a fragmented top plan view, as looking downwardly into the groove of FIG. 4.
Figure 7:
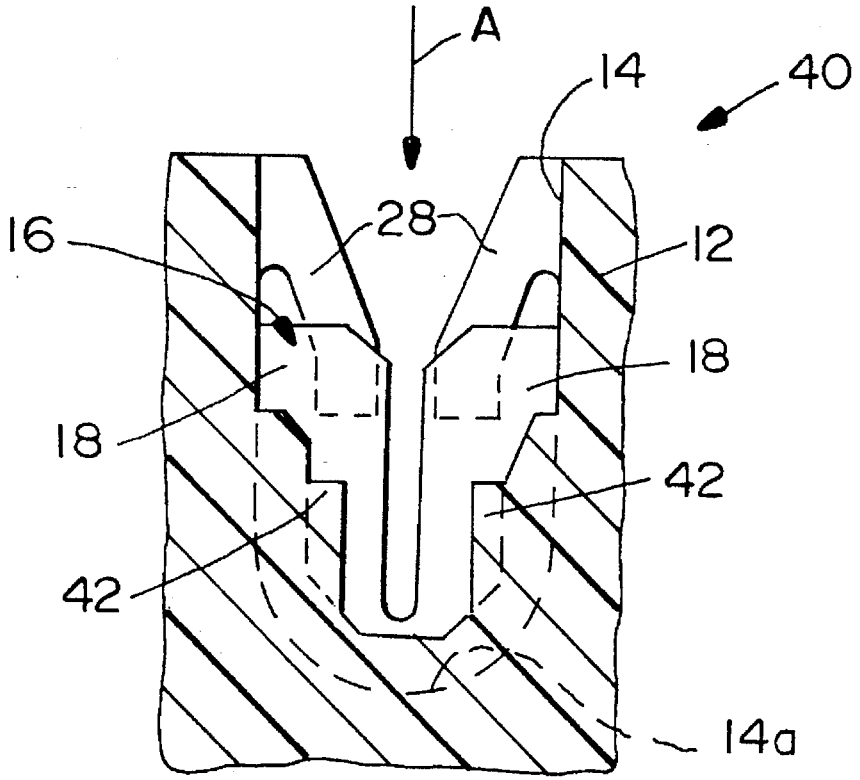
FIG. 7 is a view similar to that of FIG. 5, but showing the condition of the retention ribs prior to inserting the conductor and deforming the ribs over the conductor.

More particularly, referring to FIGS. 5, 6 and 7 in conjunction with FIGS. 3 and 4, the invention contemplates the provision of pairs of retention ribs 42 within grooves 14 for embracing and thereby retaining conductors 20 terminated by contact 16. As seen best in FIGS. 5 and 6, the ribs 42 of each pair thereof face inwardly of side walls 44 of grooves 14. As shown best in FIG. 6, one pair of retention ribs 42 are provided on each opposite longitudinal side of contact 16 and its insulation-displacement blades 18. Therefore, the ribs are very effective to hold conductor 20 terminated in the contact. It also can be seen in FIG. 6 that two pairs of wings 28 are spaced longitudinally of each groove 14, with the respective contact 16 and the two pairs of retention ribs 42 disposed therebetween. The retention ribs have inwardly facing, conductor-engaging edges 46 (FIG. 6) which preferably are flat to prevent the edges from cutting into the insulation 24 of conductors 20.

Retention ribs 42, particularly the flat inner edges 46 thereof, function to embrace or grip the conductors. Since the ribs have relatively narrow inwardly facing edges, the edges can indent into the insulation 24 of the conductors and, thereby, accommodate a wider range of conductor sizes than has been heretofore possible. In other words, FIG. 5 shows that the width of groove 14, including the semi-cylindrical bottom 14*a* thereof, is significantly larger than the diameter of conductor 20 shown in FIG. 5. The range of conductor sizes is limited only by the degree in which the edges of retention ribs 42 can indentingly grip or hold a conductor.

FIG. 5 also shows a feature of the invention wherein deformed portions 50 of retention ribs 42 overlie the terminated conductor 20 to provide a further holding or retention capability to the system. As will be described below, these deformed portions can be created during insertion of the conductor into insulation-displacement termination with its respective contact 16.

Figure 8:
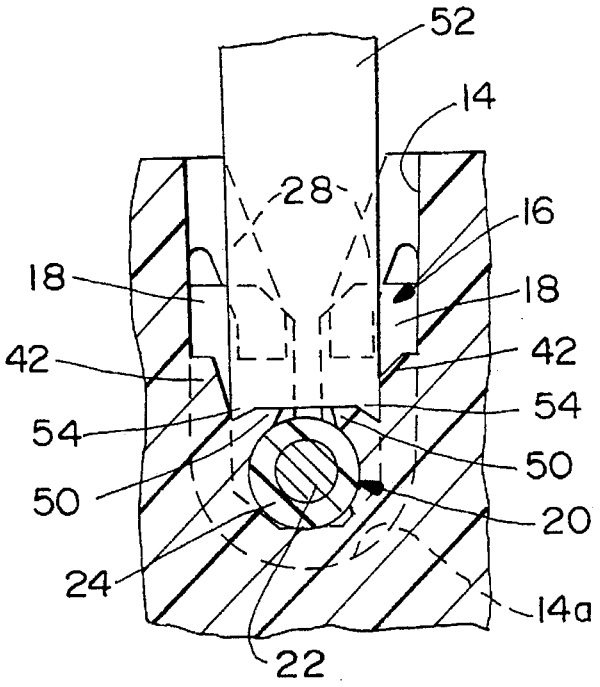
FIG. 8 is a view similar to that of FIG. 7, showing how the insertion tool deforms the ribs over the conductor.

More particularly, FIG. 8 shows one of the conductors 20 having been inserted into insulation-displacement termination between blades 18 of one of the contacts 16. However, retention ribs 42 have not been deformed over the conductor.

Figure 9:
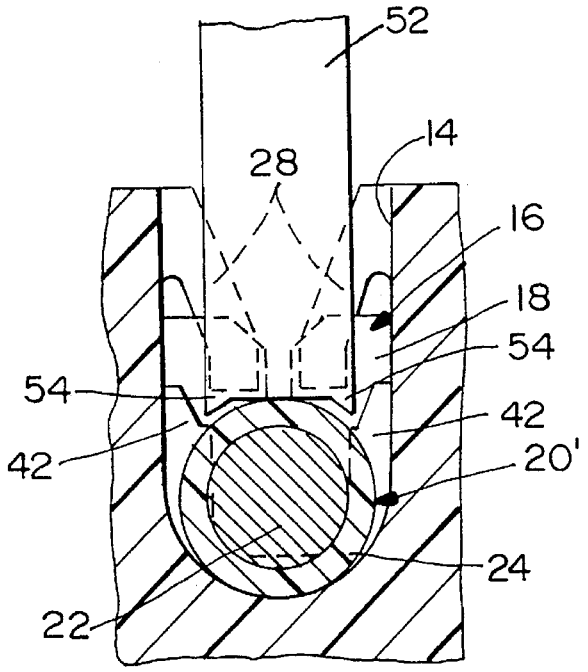
FIG. 9 is a view similar to that of FIG. 8, but showing the insertion tool inserting a larger size conductor into the connector.

Now, turning to FIG. 8 in comparison to FIG. 9, it can be seen that an insertion tool 52, having sharp corners 54, has been used to insert conductor 20 into termination with contact 16. During insertion, sharp corners 54 of the insertion tool are effective to skive or "shave" inner portions of retention ribs 42 and deform that material over the top of the conductor. Since the housing is unitarily molded of dielectric plastic material, this skived plastic material of the retention ribs is easily deformed over the top of the conductor. Therefore, the invention contemplates this method of further enhancing the conductor holding or retention capabilities of electrical connector 40.

Lastly, FIG. 9 shows an insulated conductor 20' of a larger diameter than conductor 20 in FIG. 8. With this larger diameter conductor, it can be seen that insertion tool 52 is used only for driving the conductor into its insulation-displacement termination with contact 16. In other words, the sharp corners 54 of the insertion tool are not used to skive plastic material away from retention ribs 42 because the deformed portions of the ribs are not required to securely hold the larger conductor. It also can be seen that with the larger conductor, the retention ribs indent into insulation 24 of the conductor to a significant degree. The deformed portions 50 (FIGS. 5 and 8) of the retention ribs are created primarily for the smaller diameter conductors in the range of conductor sizes that can be accommodated by the connector of the invention. Nevertheless, the retention ribs 42, in and of themselves, are effective to accommodate different sizes of conductors simply because the ribs can effectively grip the conductors by indenting the insulation thereof. The spacing between the ribs in each pair thereof should be larger than the diameter of the central conductive core 22 of the conductor so that the ribs will not cut through the outer insulation 24.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector, comprising:

a dielectric housing having a conductor-receiving groove defined at least in part by a pair of side walls between which an elongated insulated conductor is receivable essentially normally of its length;

an electrical contact having an insulation displacement termination section disposed in said groove;

a pair of inwardly-directed flexible wings in the groove and spaced from and facing one another thereby providing a slot therebetween through which the conductor is movable past free ends of the wings into insulation-displacement termination with the termination section of the contact; and a pair of retention ribs facing inwardly of the side walls of said groove essentially below the wings for embracing and thereby retaining the conductor terminated by the contact wherein said ribs include inwardly facing, conductor-engaging edges located below the free ends of the wings.

2. The electrical connector of claim 1 wherein said retention ribs include inwardly facing generally flat edges for engaging the conductor.

3. The electrical connector of claim 2 wherein the conductor includes a central conductive core surrounded by an insulative sheath, and said flat edges of the ribs are spaced apart a distance at least equal to the diameter of the conductive core.

4. The electrical connector of claim 1 wherein said edges are generally flat.

5. The electrical connector of claim 1 wherein said housing, including said wings and said retention ribs, comprises a one-piece molded structure.

6. An electrical connector, comprising:

a dielectric housing having a conductor-receiving groove defined at least in part by a pair of side walls between which an elongated insulated conductor is receivable essentially normally of its length;

an electrical contact having an insulation displacement termination section disposed in said groove;

a pair of inwardly-directed flexible wings in the groove and spaced from and facing one another thereby providing a slot therebetween through which the conductor is movable past free ends of the wings into insulation-displacement termination with the termination section of the contact; and a pair of retention ribs facing inwardly of the side walls of said groove essentially below the wings including one pair of said retention ribs on each opposite longitudinal side of said contact for embracing and thereby retaining the conductor terminated by the contact.

7. The electrical connector of claim 6, including two pairs of said wings spaced longitudinally of the groove with the contact and said pairs of retention ribs disposed therebetween.

8. An electrical connector, comprising:

a dielectric housing having a conductor-receiving groove defined at least in part by a pair of side walls between which an elongated insulated conductor is receivable essentially normally of its length;

an electrical contact having an insulation displacement termination section disposed in said groove;

a pair of inwardly-directed flexible wings in the groove and spaced from and facing one another thereby providing a slot therebetween through which the conductor is movable past free ends of the wings into insulation-displacement termination with the termination section of the contact; and a pair of retention ribs facing inwardly of the side walls of said groove essentially below the wings for embracing and thereby retaining the conductor terminated by the contact wherein said retention ribs include deformed portions overlying the terminated conductor.

9. An electrical connector, comprising:

a dielectric housing having a conductor-receiving groove defined at least in part by a pair of side walls between which an elongated insulated conductor is receivable essentially normally of its length;

an electrical contact having a termination section disposed in said groove;

at least one flexible retaining leg in the groove and past which the conductor is movable into termination with the termination section of the contact; and a pair of retention ribs facing inwardly of the side walls of the groove essentially below the retaining leg said retention ribs on each opposite longitudinal side of said contact for embracing and thereby retaining the conductor terminated by the contact.

10. The electrical connector of claim 9 wherein said retention ribs include inwardly facing generally flat edges for engaging the conductor.

11. The electrical connector of claim 9 wherein said retention ribs include deformed portions overlying the terminated conductor.

12. A method of fabricating an electrical connector, comprising the steps of providing a dielectric housing with a conductor-receiving groove defined at least in part by a pair of side walls with a pair of inwardly-directed flexible wings spaced from and facing one another thereby providing a slot therebetween, and with a pair of retention ribs facing inwardly of the side walls essentially below the wings;

mounting an electrical contact on the housing with an insulation displacement termination section disposed in the groove;

moving an elongated insulated conductor essentially normally of its length past free ends of the wings into insulation displacement termination with the termination section of the contact; and deforming portions of said retention ribs over the top of the conductor terminated by the contact.

13. The method of claim 12, including molding said housing, including said wings and said retention ribs, as a one-piece structure.

14. A method of fabricating an electrical connector, comprising the steps of providing a dielectric housing with a conductor-receiving groove defined at least in part by a pair of side walls;

mounting an electrical contact on the housing with an insulation displacement termination section disposed in the groove;

moving an elongated insulated conductor essentially normally of its length into insulation displacement termination with the termination section of the contact; and deforming portions of the housing within the groove over the top of the conductor terminated by the contact.

* * * * *